US008269675B2

(12) United States Patent
Kough et al.

(10) Patent No.: US 8,269,675 B2
(45) Date of Patent: Sep. 18, 2012

(54) ANTENNAS FOR ELECTRONIC DEVICES WITH CONDUCTIVE HOUSING

(75) Inventors: Douglas B. Kough, San Jose, CA (US); Gregory A. Springer, Sunnyvale, CA (US); Bing Chiang, Melbourne, FL (US); Enrique Ayala Vazquez, Watsonville, CA (US); Hao Xu, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 635 days.

(21) Appl. No.: 12/490,286

(22) Filed: Jun. 23, 2009

(65) Prior Publication Data

US 2010/0321255 A1 Dec. 23, 2010

(51) Int. Cl.
*H01Q 1/24* (2006.01)

(52) U.S. Cl. ..... 343/702; 343/767

(58) Field of Classification Search ..... 343/702, 343/767, 700 MS, 872
See application file for complete search history.

(56) References Cited

U.S. PATENT DOCUMENTS 6,339,400 B1 * 1/2002 Flint et al. ..... 343/702
6,380,930 B1 4/2002 Van Ruymbeke
6,396,444 B1 5/2002 Goward et al.
6,509,877 B2 * 1/2003 Masaki ..... 343/702
6,640,113 B1 10/2003 Shim et al.
6,667,719 B2 12/2003 LaKomski
6,759,986 B1 7/2004 Saliga et al.
6,973,709 B2 12/2005 Huang
7,034,762 B2 * 4/2006 Huang ..... 343/767
7,142,886 B2 * 11/2006 Murayama et al. ..... 455/556.1
2004/0051670 A1 * 3/2004 Sato ..... 343/702
2011/0136447 A1 6/2011 Pascolini et al.
2011/0241949 A1 10/2011 Nickel et al.

OTHER PUBLICATIONS

Caballero et al., U.S. Appl. No. 12/941,010, filed Nov. 5, 2010.
Chiang et al, U.S. Appl. No. 11/959,191, filed Dec. 18, 2007.
R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18.

* cited by examiner

*Primary Examiner* — Hoanganh Le
(74) *Attorney, Agent, or Firm* — Treyz Law Group; G. Victor Treyz; David C. Kellogg

(57) ABSTRACT

An electronic device may be provided with a conductive housing. The conductive housing may be formed from a metal. Slots may be formed in the housing. The slots may serve as an antenna and may be fed using an antenna feed structure within the electronic device housing. The electronic device may have a frame to which housing structures are attached and may have a stand or other support structure. The frame may be used to mount a display, to support housing walls, to support clutch barrel structures, etc. The slots may be formed in the frame or in a space between the frame and the housing walls. The slots or other antenna structures may also be formed in the stand. Multiple slots may be used together to support operations in two or more communications bands. There may be multiple dual slot antennas in the electronic device.

20 Claims, 17 Drawing Sheets

ANTENNAS FOR ELECTRONIC DEVICES WITH CONDUCTIVE HOUSING

BACKGROUND

This invention relates to electronic device antennas, and more particularly, to antennas for electronic devices with conductive housings.

Electronic devices such as portable computers and handheld electronic devices are becoming increasingly popular. Examples of portable devices include handheld computers, cellular telephones, media players, and hybrid devices that include the functionality of multiple devices of this type.

Devices such as these are often provided with wireless communications capabilities. For example, electronic devices may use long-range wireless communications circuitry such as cellular telephone circuitry to communicate using cellular telephone bands at 850 MHz, 900 MHz, 1800 MHz, and 1900 MHz (e.g., the main Global System for Mobile Communications or GSM cellular telephone bands). Long-range wireless communications circuitry may also use the 2100 MHz band. Electronic devices may use short-range wireless communications links to handle communications with nearby equipment. For example, electronic devices may communicate using the WiFi® (IEEE 802.11) bands at 2.4 GHz and 5 GHz (sometimes referred to as local area network bands) and the Bluetooth® band at 2.4 GHz.

It can be difficult to incorporate antennas successfully into an electronic device. Some electronic devices are manufactured with small form factors, so space for antennas is limited. Antenna operation can also be blocked by intervening metal structures. This can make it difficult to implement an antenna in an electronic device that contains conductive display structures, conductive housing walls, or other conductive structures that can potentially block radio-frequency signals.

It would therefore be desirable to be able to provide improved antennas for portable electronic devices that have conductive housings.

SUMMARY

Antennas are provided for electronic devices such as devices that have conductive housing. The antennas may be slot antennas that are formed from slots in conductive housing structures. The slot antennas may be formed form a dielectric-filled logo structure that is formed in a conductive housing. Slot antennas may also be formed from a slot between a conductive housing and an internal frame or from one or more slots in an internal frame. If desired, slot antennas may be formed in a stand that supports a portable electronic device. Antennas may be fed by antenna feed structures within the conductive housing.

The electronic device may be a portable computer or a handheld electronic device such as a cellular telephone. The housing may contain conductive sidewalls. For example, the housing may be formed from a machined block of aluminum or other metals. The walls of the housing may be used to hold conductive components such as displays. The housing may have internal frame members. Integrated circuits and other electronic components may be mounted within the housing.

Slot antennas may be formed directly in the conductive housing of the electronic device. Forming antennas directly in electronic device housing may prevent antennas from being shielded by the conductive housing material. Slot antennas may also be formed in the internal frame members of an electronic device. Slot antennas may also be formed in gaps between conductive housing and an internal frame member.

Slot antennas may have open or closed slots. Slot antennas may be single-band or dual-band slot antennas.

Further features of the invention, its nature and various advantages will be more apparent from the accompanying drawings and the following detailed description of the preferred embodiments.

DETAILED DESCRIPTION

Figure 1:
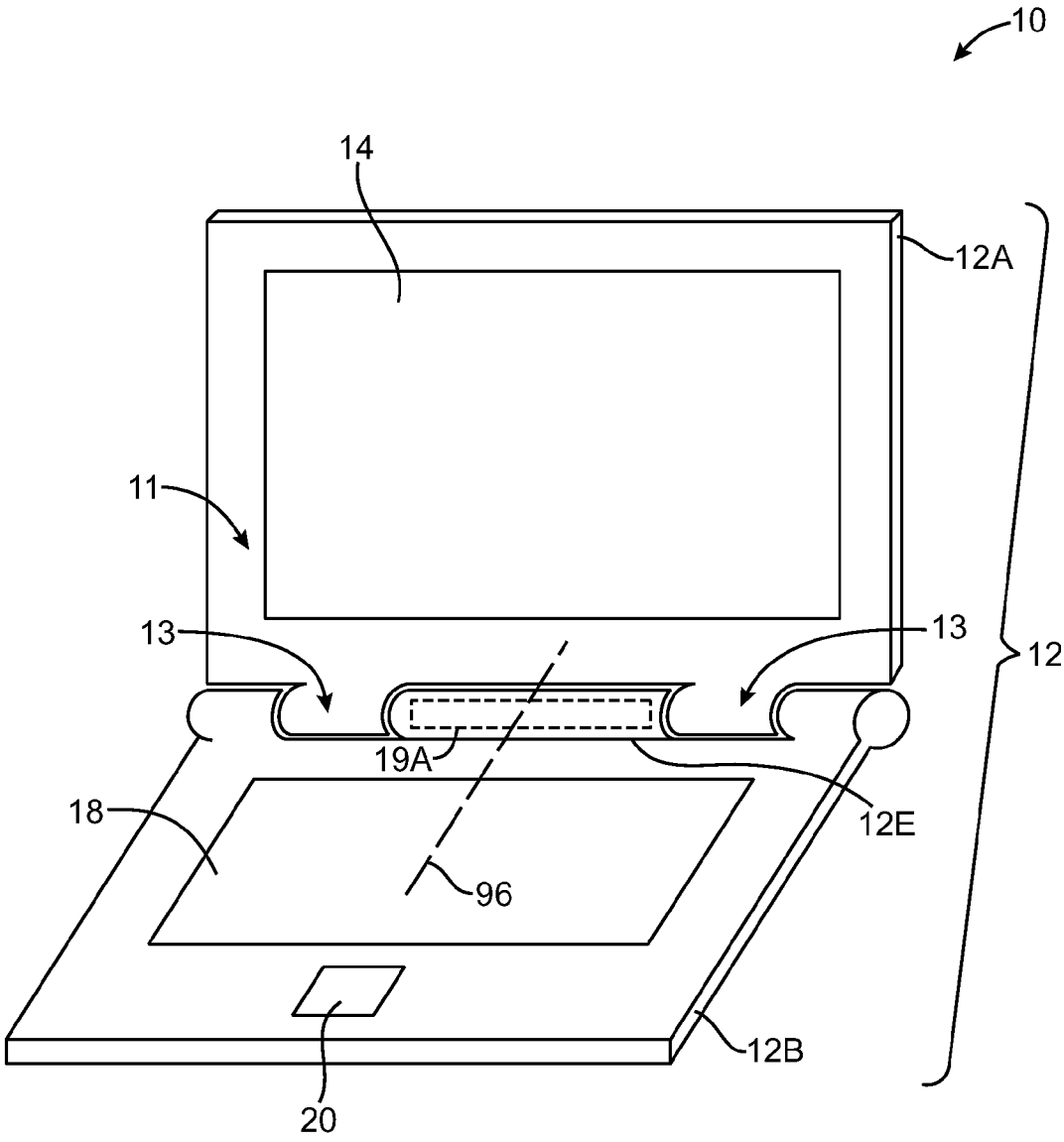
FIG. 1 is a front perspective view of an illustrative electronic device in accordance with an embodiment of the present invention.

An illustrative portable device such as a portable computer that may include a slot antenna is shown in FIG. 1. As shown in FIG. 1, device 10 may be a portable computer having a housing such as housing 12. Housing 12 may have an upper portion such as upper housing 12A, which is sometimes referred to as a lid or cover. Housing 12 may also have a lower portion such as lower housing 12B, which is sometimes referred to as the housing base or main unit. Housing portions 12A and 12B may be pivotably attached to each other using hinge structures such as hinges 13 (sometimes referred to as clutch barrel hinges). Housing portion 12E may surround a section of device 10 between hinges 13. Housing portion 12E may be attached to lower housing 12B or may be integral with lower housing 12B. Display 14 may be mounted in upper housing 12A. Other components such as keyboard 18 and touch pad 20 may be mounted in lower housing 12B. Display 14 may be a liquid crystal display (LCD), an organic light emitting diode (OLED) display, a plasma display, or any other suitable display. The outermost surface of display 14 may be formed from one or more plastic or glass layers. If desired, touch screen functionality may be integrated into display 14. In FIG. 1, display 14 and keyboard 18 are shown mounted on a front face 11 of housing 12.

Housing 12, which is sometimes referred to as a case, may be formed of any suitable materials including, plastic, wood, glass, ceramics, metal, or other suitable materials, or a combination of these materials. In some situations, housing 12 may be a dielectric or other low-conductivity material, so that the operation of conductive antenna elements that are located in proximity to housing 12 is not disrupted.

Housing 12 or portions of housing 12 may also be formed from conductive materials such as metal. An advantage of forming housing 12 from metal or other structurally sound conductive materials is that this may improve device aesthetics and may help improve durability and portability. An illustrative metal housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc.

If desired, internal frames may be mounted within housing 12. These internal frames may be used for mounting electronic components such as a battery, printed circuit boards containing integrated circuits and other electrical devices, etc. If desired, printed circuit boards (e.g., a motherboard and other printed circuit boards) and other components may be mounted directly to housing 12.

When housing 12 is formed from conductive materials such as metal, housing 12 can act as a conductive shield that impedes the passage of radio-frequency signals from nearby antennas. It may therefore be challenging for an antenna that is located inside conductive housing to transmit and receive radio-frequency signals.

In scenarios in which housing 12 is formed from metal elements, one or more of the metal elements may therefore be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printed circuit board structure used in forming antenna structures for device 10).

Figure 2:
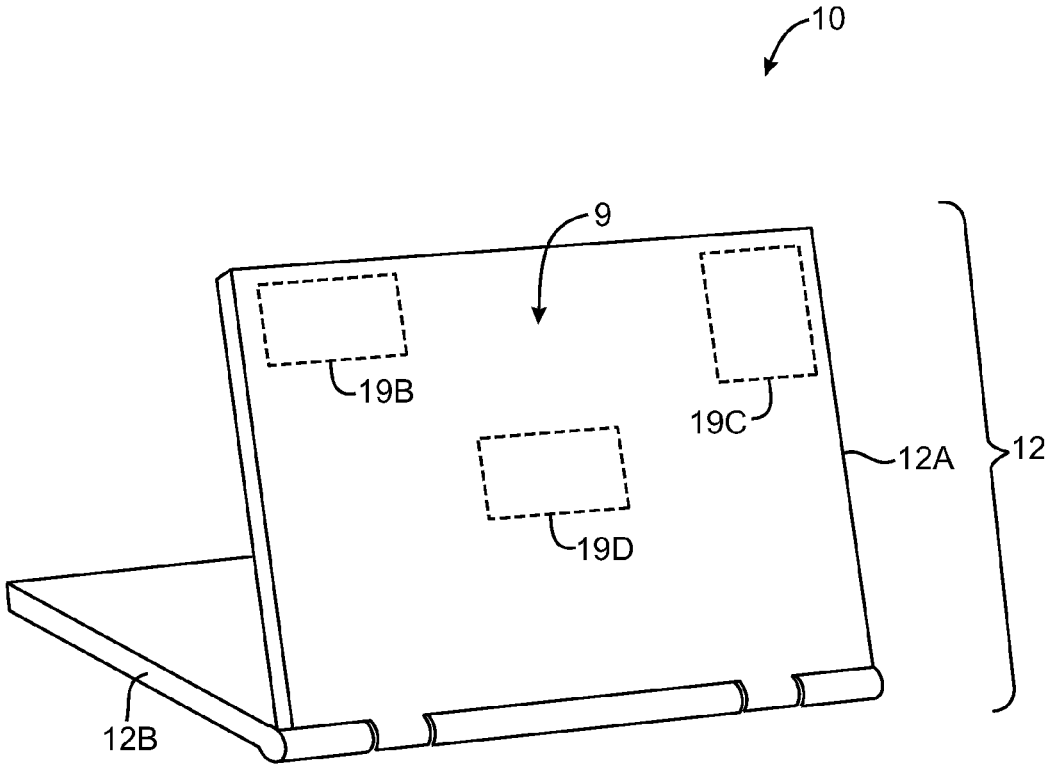
FIG. 2 is a rear perspective view of an illustrative electronic device in accordance with an embodiment of the present invention.

Moreover, slots in housing 12 may be used in forming an antenna resonating element for an antenna. Slot antennas having slots formed in accessible portions of housing 12 may freely transmit and receive radio-frequency signals that are not blocked by conductive housing 12. Slots for antenna resonating elements may be located anywhere on housing 12. These slots may be filled with air, plastic or other suitable dielectric material. As shown in FIG. 1, a slot antenna may be formed in dashed region 19A on housing 12E if housing 12E is formed of conductive materials. Slots for antennas may also be formed in an internal frame within housing 12E (e.g., in the clutch barrel just below region 19A between hinges 13). If slots are formed in an internal frame, housing 12E may be formed of dielectric materials or may have a dielectric antenna window to allow radio-frequency signals to pass through housing 12E. FIG. 2 shows a rear view of device 10. Slot antennas for device 10 of FIG. 2 may be formed in upper housing 12A as shown by dashed antenna regions 19B, 19C, and 19D. Slot antennas may be formed in a corner of housing 12A, such as in region 19B or 19C, or slot antennas may be formed in the center of housing 12A, as shown by region 19D. Device 10 may also have multiple slot antennas formed in different regions of housing 12. For example, a given device 10 may have slot antennas formed in both regions 19B and 19C in housing 12A. Slot antennas may also be formed in lower housing 12B. In FIG. 2, slot antennas are shown as being formed in regions 19B, 19C, and 19D on a back face 9 of housing 12. Device 10 may optionally have a dielectric-filled logo structure formed in housing 12 such as in regions 19B-19D of housing 12. A slot antenna may be formed as part of a dielectric-filled logo structure (e.g., if part of the logo forms a slot). Slot antennas may also be formed adjacent to display 14 or keyboard 18 on front face 11 of housing 12 in FIG. 1. Each slot antenna may have one slot, two slots, or more slots. Each slot antenna may be a single band or dual band antenna and may use open or closed slots. Device 10 may have hybrid antennas formed from slot antenna structures merged with other types of antennas.

Figure 3:
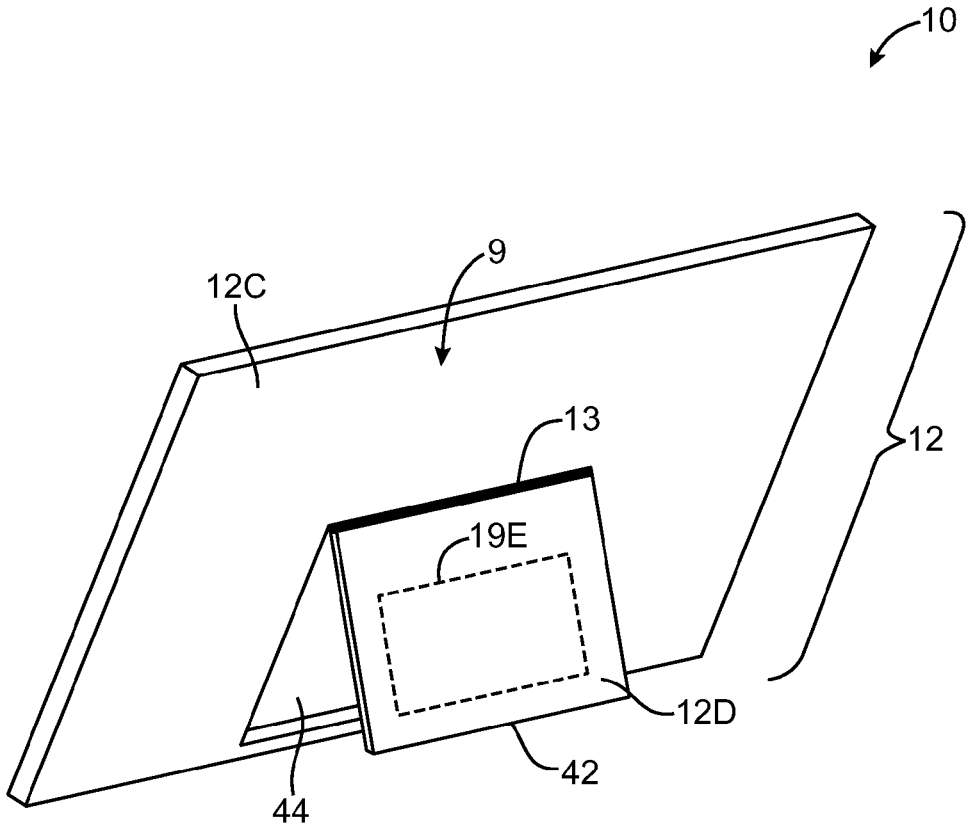
FIG. 3 is a rear perspective view of an illustrative electronic device with a stand in accordance with an embodiment of the present invention.

FIG. 3 shows a portable electronic device 10 that has a stand 42. Device 10 has a housing 12. Housing 12 may have a main portion 12C and a stand portion 12D. Device 10 in FIG. 3 may be a tablet computer. Stand 42 may be pivotably attached by hinge 13 to back face 9 of device 10. Housing 12D of stand 42 may be made of conductive or nonconductive materials. Stand 42 may have an open position so that stand 42 holds device 10 in an upright or inclined position when device 10 is placed on a flat surface. Stand 42 may also have a closed position. When stand 42 is in a closed position, stand 42 may be positioned in a recess 44 in housing 12.

Slot antennas may be formed in stand 42 such as in dashed region 19E of FIG. 3. If housing 12D of stand 42 is formed from conductive materials, slot antennas may be formed in stand 42 using slots that are formed directly in housing 12D. These slots may be filled with air, epoxy, plastic, or other suitable dielectric material. A slot antenna formed in stand 42 may be a single band, dual band, or multiple band antenna. Device 10 may have multiple antennas including an antenna formed in stand 42 and other antennas.

If housing portion 12D is formed at least partly from nonconductive materials, antennas may be placed within housing 12D of stand 42. Any suitable antenna may be placed inside stand 42. An antenna positioned inside stand 42 may include antennas structures such as slot antenna structures, inverted-F antenna structures, monopole antenna structures, patch antenna structures or other suitable antenna structures. If main housing portion 12C is made of conductive materials, housing portion 12C may form part of a ground plane element for an antenna located in stand 42. Antennas in stand 42 may be used in conjunction with antennas formed in other parts of device 10.

Figure 4:
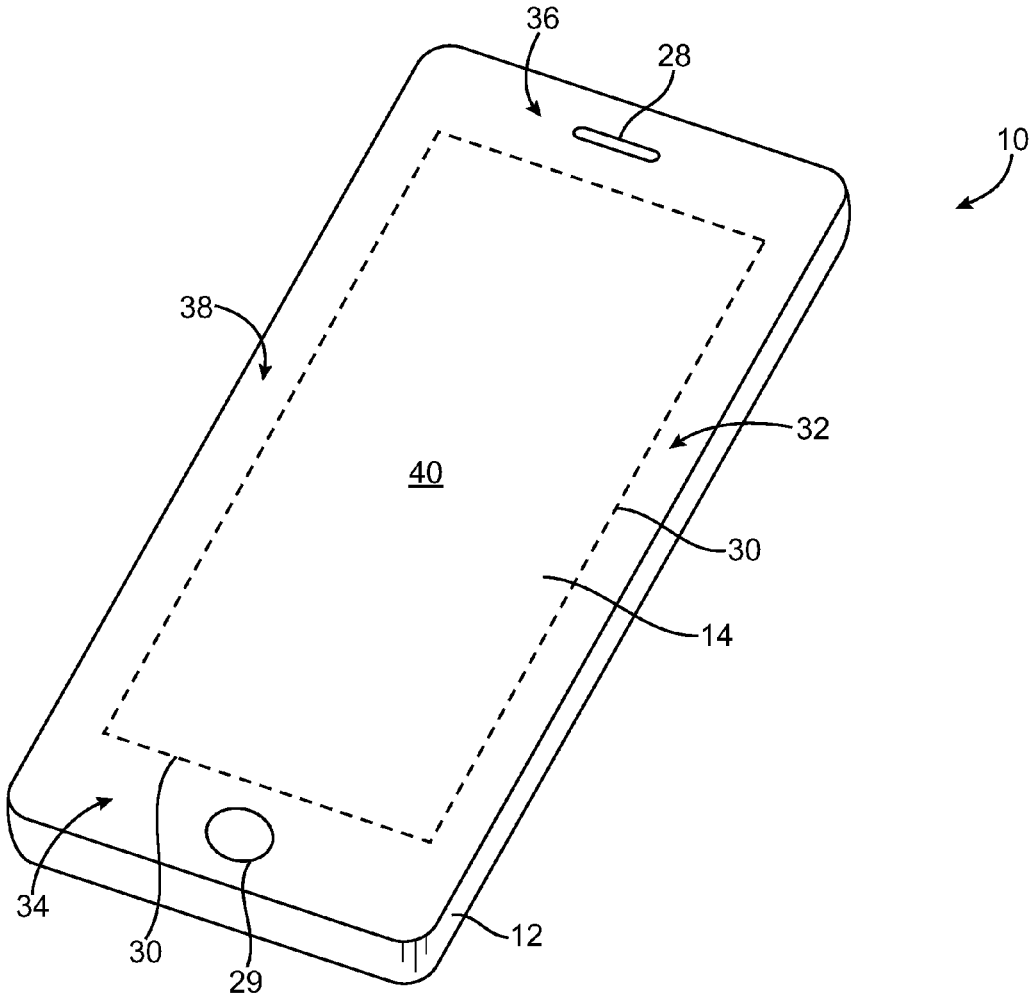
FIG. 4 is a front perspective view of an illustrative handheld electronic device in accordance with an embodiment of the present invention.

Another illustrative electronic device arrangement that may be used for device 10 is shown in FIG. 4. As shown in FIG. 4, device 10 may be a handheld electronic device having a housing such as housing 12 and a planar front surface on which display 14 is mounted. Components such as speaker port 28 and menu button 29 may, if desired, protrude through portions of display 14 (i.e., its associated glass cover). Display 14 may be, for example, a touch sensitive display that contains both light-emitting components and touch sensitive components. With this type of display arrangement, light may be emitted from active central region 40 of display 14, but not from inactive peripheral regions such as right-hand edge 32, left-hand edge 38, upper portion 36, and lower edge region 34. These peripheral regions may have an undercoating of an opaque substance such as a black ink (as an example) to help cover underlying structures from view.

Figure 5:
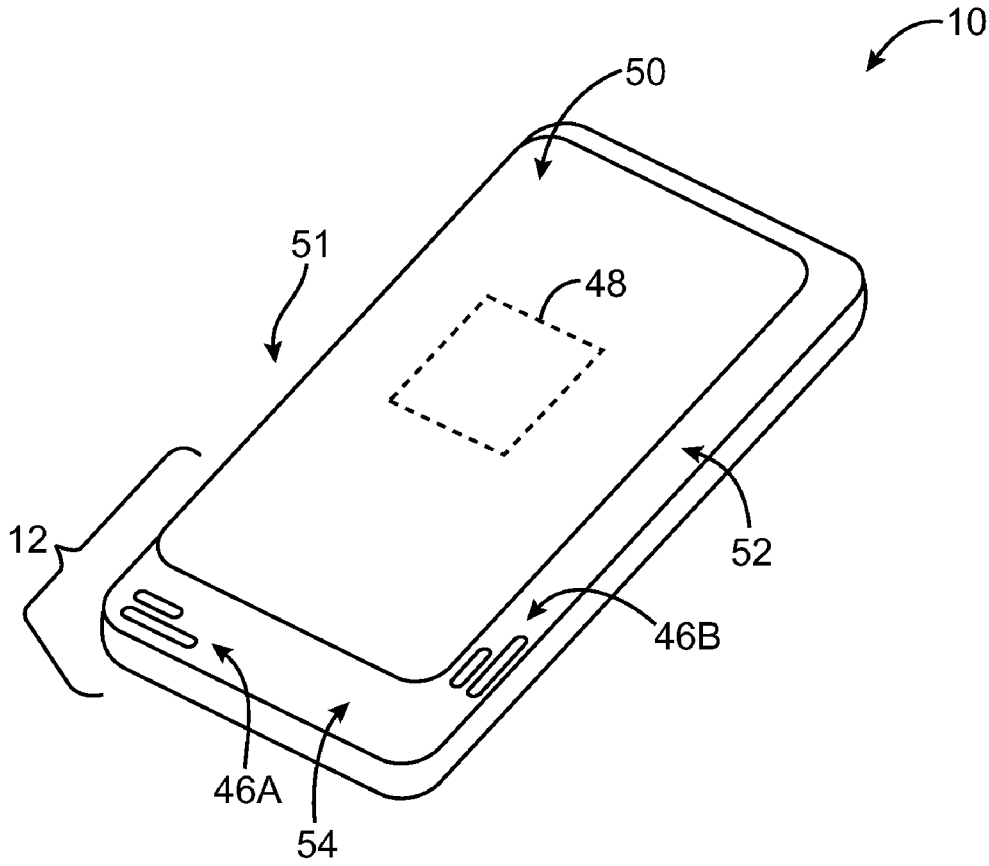
FIG. 5 is a rear perspective view of an illustrative handheld electronic device in accordance with an embodiment of the present invention.

FIG. 5 shows a rear view of electronic device 10 of FIG. 4. Device 10 may have a rear surface 50, side surfaces 51 and 52, and a bottom surface 54. Surfaces 50, 51, 52, and 54 need not be flat surfaces (i.e., these surfaces may be curved). Slot antenna 46A is shown on bottom surface 54 and slot antenna 46B is shown on side surface 52. In FIG. 5, slot antennas 46A and 46B are dual band antennas each having two slots of different lengths. In general, slot antennas may have slots of any suitable lengths. Slot antennas 46A and 46B may also be formed using slot antenna resonating elements that have single slots. If desired, slot antennas may also be formed in region 48 or elsewhere on rear surface 50. A dielectric-filled logo structure for device 10 may also be positioned in region 48. A slot antenna may be implemented as part of a dielectric-filled logo structure. For example, the logo may be formed from a dielectric-filled logo-shaped opening in housing 12. The logo-shaped opening may have a narrow portion that forms a slot for a slot antenna.

Figure 6:
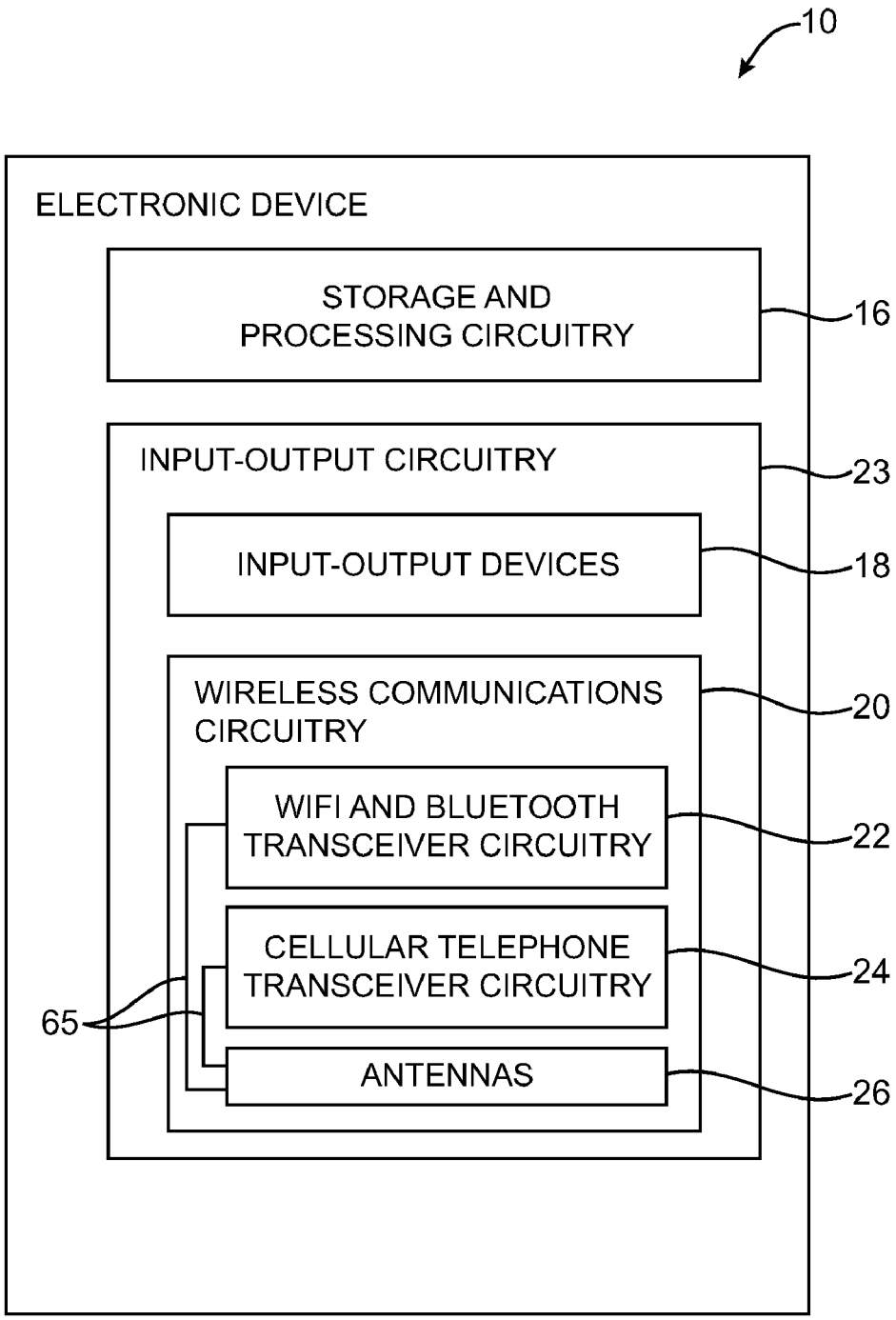
FIG. 6 is a schematic diagram of an illustrative electronic device with antenna structures in accordance with an embodiment of the present invention.

FIG. 6 shows a schematic diagram of electronic device 10. Electronic device 10 may be a portable device such as a mobile telephone, a mobile telephone with media player capabilities, a handheld computer, a remote control, a game player, a global positioning system (GPS) device, a laptop computer, a tablet computer, an ultraportable computer, a combination of such devices, or any other suitable portable electronic device.

As shown in FIG. 6, electronic device 10 may include storage and processing circuitry 16. Storage and processing circuitry 16 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 16 may be used to control the operation of device 10. Processing circuitry 16 may be based on a processor such as a microprocessor and other suitable integrated circuits. With one suitable arrangement, storage and processing circuitry 16 may be used to run software on device 10, such as internet browsing applications, voice-over-internet-protocol (VOIP) telephone call applications, email applications, media playback applications, operating system functions, etc. Storage and processing circuitry 16 may be used in implementing suitable communications protocols.

Communications protocols that may be implemented using storage and processing circuitry 16 include internet protocols, wireless local area network protocols (e.g., IEEE 802.11 protocols—sometimes referred to as WiFi®), protocols for other short-range wireless communications links such as the Bluetooth® protocol, protocols for handling 3G communications services (e.g., using wide band code division multiple access techniques), 2G cellular telephone communications protocols, etc. Storage and processing circuitry 16 may have cellular telephone circuitry to communicate using cellular telephone bands at 850 MHz, 900 MHz, 1800 MHz, and 1900 MHz (e.g., the main Global System for Mobile Communications or GSM cellular telephone bands) and may implement protocols for handling 3G communications services. Long-range wireless communications circuitry may also handle the 2100 MHz band.

Input-output device circuitry 23 may be used to allow data to be supplied to device 10 and to allow data to be provided from device 10 to external devices. Input-output devices 18 such as touch screens and other user input interfaces are examples of input-output circuitry 23. Input-output devices 18 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices may be included in devices 18 such as liquid-crystal display (LCD) screens, light-emitting diodes (LEDs), organic light-emitting diodes (OLEDs), and other components that present visual information and status data. Display and audio components in input-output devices 18 may also include audio equipment such as speakers and other devices for creating sound. If desired, input-output devices 18 may contain audio-video interface equipment such as jacks and other connectors for external headphones and monitors.

Wireless communications circuitry 20 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 20 may include radio-frequency transceiver circuits for handling multiple radio-frequency communications bands. For example, circuitry 20 may include transceiver circuitry 22 that handles 2.4 GHz and 5 GHz bands for WiFi® (IEEE 802.11) communications and the 2.4 GHz Bluetooth communications band. Circuitry 20 may also include cellular telephone transceiver circuitry 24 for handling wireless communications in cellular telephone bands such as the GSM bands at 850 MHz, 900 MHz, 1800 MHz, and 1900 MHz, and the 2100 MHz data band (as examples). Wireless communications circuitry 20 can include circuitry for other short-range and long-range wireless links if desired. For example, wireless communications circuitry 20 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 20 may include antennas 26. Device 10 may be provided with any suitable number of antennas. There may be, for example, one antenna, two antennas, three antennas, or more than three antennas, in device 10. Each antenna may handle communications over a single communications band or multiple communications bands. If desired, a dual band antenna may be used to cover two WiFi bands (e.g., 2.4 GHz and 5 GHz). Different types of antennas may be used for different bands and combinations of bands. For example, it may be desirable to form a dual band antenna for forming a local wireless link antenna, a multiband antenna for handling cellular telephone communications bands, and a single band antenna for forming a global positioning system antenna (as examples).

Paths 65 such as transmission line paths may be used to convey radio-frequency signals between transceivers 22 and 24 and antennas 26. Radio-frequency transceivers such as radio-frequency transceivers 22 and 24 may be implemented using one or more integrated circuits and associated components (e.g., switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 65 may be used to interconnect the transceiver integrated circuits and other components on the printed circuit board with antenna structures in device 10. Paths 65 may include any suitable conductive pathways over which radio-frequency signals may be conveyed including transmission line path structures such as coaxial cables, microstrip transmission lines, etc.

Figure 7:
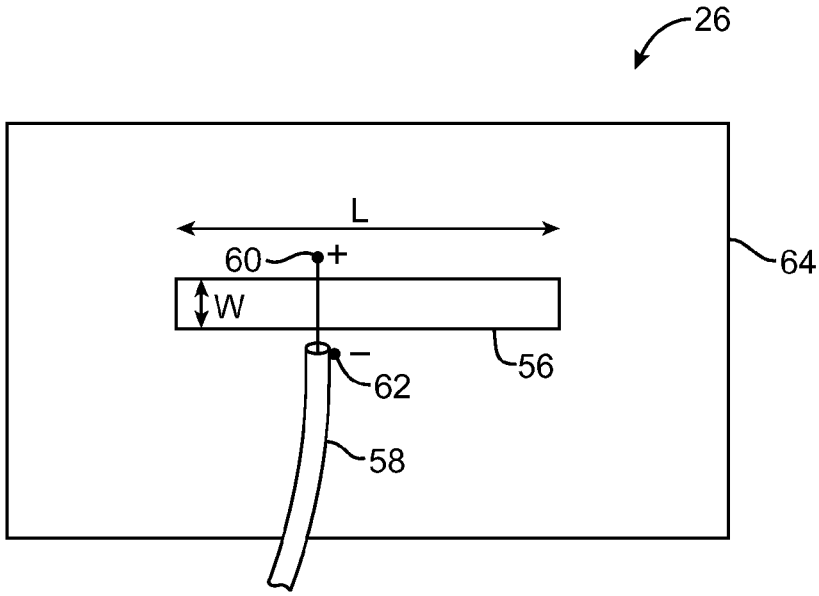
FIG. 7 is a diagram of an illustrative single-slot antenna in accordance with an embodiment of the present invention.

FIG. 7 shows an antenna structure that may be formed in conductive housing of device 10. As shown in FIG. 7, antenna 26 may be formed from a ground plane structure such as ground plane 64. Ground plane 64 may be formed from conductive housing 12 of device 10 (see, e.g., FIGS. 1-5). Ground plane 64 may be formed from a printed circuit board, a planar metal structure, conductive electrical components, conductive housing walls, other suitable conductive structures, or combinations of these structures. With one suitable arrangement, ground plane 64 may be formed from one or more conductive layers on a printed circuit board. The printed circuit board may be rigid or flexible. An example of a rigid circuit board substrate is fiberglass-filled epoxy (e.g., FR4). An example of a flexible printed circuit board material is polyimide. Flexible printed circuits are sometimes referred to as flex circuits and may be mounted to dielectric support structures such as plastic supports.

An antenna resonating element for antenna 26 may be formed from an opening 56 in ground plane 64. Opening 56 may be filled with air or with a solid dielectric such as plastic or epoxy. As opening 56 has a length L that is longer than its width W, openings of this type are often referred to as a slots.

Slot 56 serves as an antenna resonating element for antenna 26, and ground plane 64 serves as a ground plane element for antenna 26. The slot and ground plane are sometimes referred to as forming a "pole" for antenna 26.

Any suitable feed arrangement may be used to feed antenna 26. As shown schematically in the example of FIG. 7, a transmission line such as a coaxial transmission line may be used to convey radio-frequency signals between antenna 26 and a radio-frequency transceiver such as WiFi and Bluetooth transceiver circuitry 22 and cellular telephone transceiver circuitry 24 of FIG. 6.

Transmission line 58 may be coupled to antenna 26 at feed terminals such as feed terminals 60 and 62. Feed terminal 62 may be referred to as a ground or negative feed terminal and may be shorted to the outer (ground) conductor of transmission line 22. Feed terminal 60 may be referred to as the positive antenna terminal. The transmission line center conductor may be used to connect transmission line 58 to positive feed terminal 60. If desired, other types of antenna coupling arrangements may be used (e.g., based on near-field coupling, using impedance matching networks, etc.).

Figure 8:
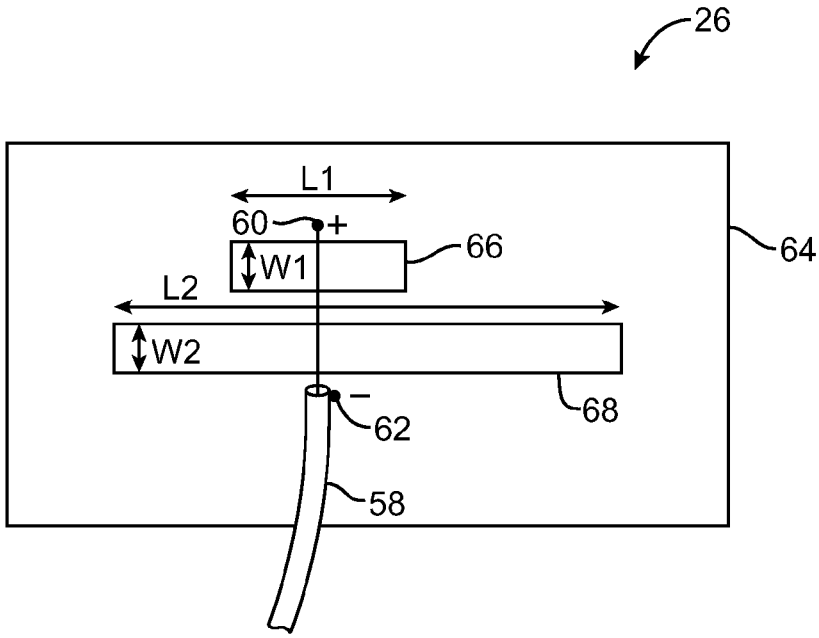
FIG. 8 is a diagram of an illustrative dual-slot antenna in accordance with an embodiment of the present invention.

Another illustrative slot antenna is shown in FIG. 8. Antenna 26 of FIG. 8 has ground plane 64. Ground plane 64 may be formed from conductive housing 12 in FIGS. 1-5 or other conductive structures (e.g., a housing frame member, etc.). Ground plane 64 may also be formed from a rigid or flexible printed circuit board, a planar metal structure, conductive electrical components, or other suitable conductive structures.

Antenna resonating elements for antenna 26 may be formed from two openings in ground plane 64, as shown in FIG. 8. These openings, often referred to as slots, may be filled with air or other suitable dielectrics such as plastic. Slots 66 and 68 may have any suitable shapes. Slot 66 may have length L1 and width W1. Slot 68 may have a length L2 and a width W2. In a typical configuration slots 66 and 68 have longitudinal dimensions that significantly exceed their lateral dimensions. Slots 66 and 68 may have different lengths and widths. Slot widths W1 and W2 may be, for example, about 0.1 to 0.5 mm, about 100 μm to 0.1 mm, more than 100 μm, more than 0.1 mm, more than 0.5 mm, etc. The length of slots 66 and 68 may be substantially equal to half of a wavelength at the slot's frequency of operation (e.g., several mm to several cm). Each slot may be configured to provide coverage in a different communications band.

Slots 66 and 68 serve as antenna resonating elements for antenna 26, and ground plane 64 serves as a ground plane element for antenna 26. A first antenna structure may be formed by slot 66 (which serves as a first of two antenna poles for the first antennas structure) and ground plane 64 (which serves as a second of two antenna poles for the first antenna structure). Similarly, a second antenna structure can be formed from slot 68 (which serves as a first of two antenna poles for the second antenna structure) and ground plane 64 (which serves as a second of two antenna poles for the second antenna structure). Slots 66 and 68 may resonate at different frequencies, so that the antenna that is formed from slots 66 and 68 (and from ground plane 64) serves as a multiband antenna. The slot shapes may also be selected so that harmonics from one slot overlap the frequency response of the over slot. The antenna structure formed from slot 66 and ground plane 64 may handle a first communication band, whereas the antenna structure formed from slot 68 and ground plane 64 may handle a second communications band. Communications bands covered by antenna 26 may include cellular telephone bands such as the 850 MHz, 900 MHz, 1800 MHz, 1900 MHz bands, or the 2100 MHz data band or the 2.4 GHz and 5 GHz bands for WiFi® (IEEE 802.11) communications or the 2.4 GHz Bluetooth communications band (as examples).

Any suitable feed arrangement may be used to feed antenna 26. As shown schematically in FIG. 8, a transmission line such as a coaxial transmission line 58 may be coupled to antenna 26 at feed terminals such as feed terminals 60 and 62. Negative (ground) feed terminal 62 may be shorted to the outer (ground) conductor of transmission line 58. Positive feed terminal 60 may be shorted to the center conductor of transmission line 58. If desired, other types of antenna coupling arrangements may be used (e.g., based on near-field coupling, using impedance matching networks, etc.).

Figure 9:
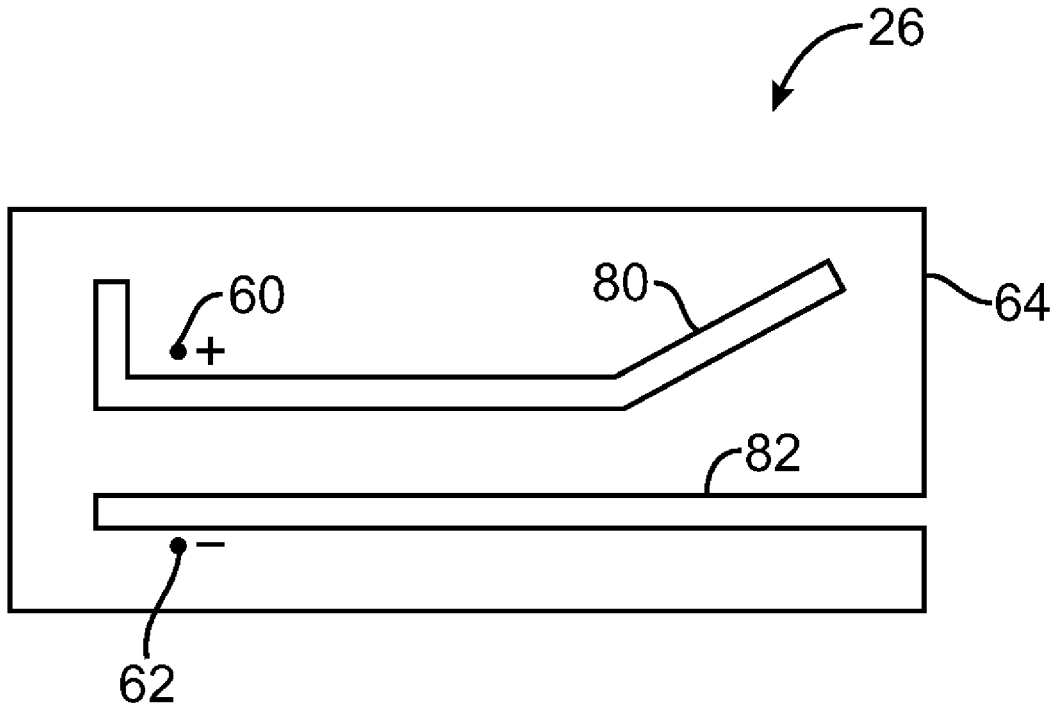
FIG. 9 is a diagram of an illustrative antenna having a closed slot and an open slot in accordance with an embodiment of the present invention.

Antennas 26 may have slots that are open or closed. In the example of FIG. 9, antenna 26 has a ground plane 64 with closed slot 80 and open slot 82. Slots 80 and 82 serve as antenna resonating elements and ground plane 64 serves as a ground plane element. Ground plane 64 may be formed from conductive housing 12 of FIGS. 1-5. The antenna formed from structures 64 of FIG. 9 may be fed using positive antenna feed terminal 60 and ground antenna feed terminal 62. In this type of arrangement, slot 80 and ground plane 64 may serve as pair of poles for a first antenna resonating structure. Slot 82 and ground plane 64 may serve as a pair of poles for a second antennas resonating structure. Slots 64 and 66 may have any suitable shape. Slots 64 and 66 may be straight or slots 64 and 66 may be angled. In FIG. 9, open slot 82 is shown as straight and closed slot 80 is shown as having angles. Any suitable feeding arrangement may be used to feed antenna 26 in FIG. 9. For example, a coaxial transmission line may be used to feed antenna 26 in FIG. 9.

The sizes of slots 80 and 82 may be configured so that antenna 26 operates in desired communications bands (e.g., 2.4 GHz and 5 GHz, etc.). The length associated with an open slot such as slot 82 may be substantially equal to a quarter of a wavelength at the slot's frequency of operation. For example, the length L1 of open-ended slot 82 may be substantially equal to a quarter of a wavelength in a first communications band (i.e., at 2.4 GHz, etc.). The length of a close-ended slot such as closed slot 80 may be substantially equal to half of a wavelength at the slot's frequency of operation (i.e., its perimeter may be one wavelength in length). For example, the length L2 of close-ended slot 80 may be substantially equal to half of a wavelength in a second communications band (i.e., at 5 GHz, etc).

Figure 10:
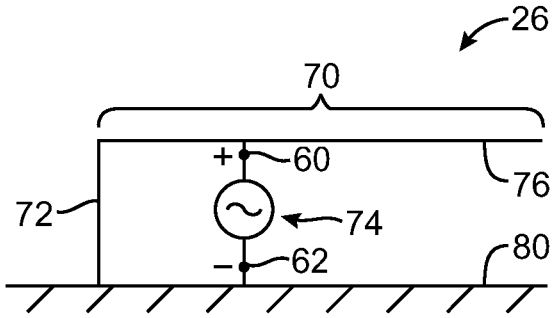
FIG. 10 is a diagram of an illustrative inverted-F antenna resonating element for an antenna in accordance with an embodiment of the present invention.

Other illustrative antenna structures that may be used in forming an antenna for device 10 (e.g., as part of stand 42 of FIG. 3) include inverted-F antenna structures such as the inverted-F antenna structure of FIG. 10. Antenna 26 of FIG. 10 may be fed by radio-frequency source 74 (transceivers 22 and 24 of FIG. 6) at positive antenna feed terminal 60 and ground antenna feed terminal 62. Positive antenna feed terminal 60 may be coupled to antenna resonating element 70. Ground antenna feed terminal 62 may be coupled to ground element 80. Resonating element 70 may have a main arm 76 and a shorting branch 72 that connects main arm 76 to ground 80. Antenna 26 of FIG. 10 may be formed in a region such as region 19E of stand 42 of FIG. 3. Ground 80 may be coupled to housing 12, housing 12C, or another suitable ground plane element.

Figure 11:
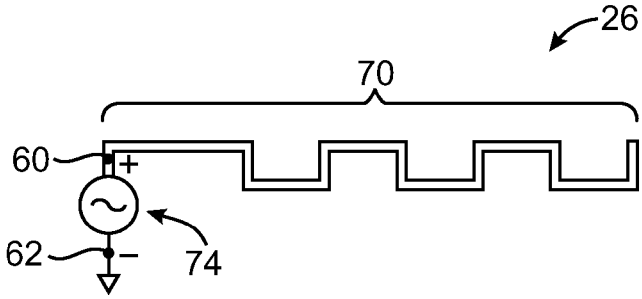
FIG. 11 is a diagram of an illustrative monopole antenna resonating element for an antenna in accordance with an embodiment of the present invention.

FIG. 11 shows an illustrative arrangement for antenna 26 that is based on a monopole antenna configuration. In the example of FIG. 11, resonating element 70 of antenna 26 has a meandering serpentine path shape. Positive feed terminal 60 may be connected to one end of resonating element 70. Antenna 26 in FIG. 11 may be formed in stand 42 of FIG. 3. Ground feed terminal 62 may be coupled to housing 12 or another suitable ground plane element.

Figure 12:
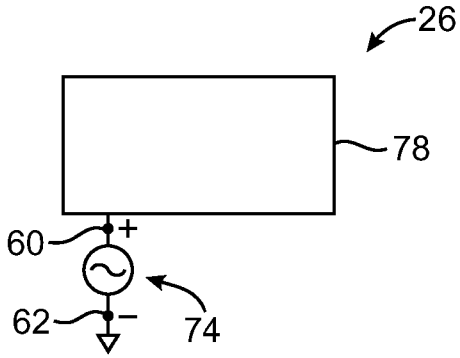
FIG. 12 is a top view of an illustrative patch antenna resonating element for an antenna in accordance with an embodiment of the present invention.

Another possible configuration for antenna 26 is shown in FIG. 12. In the arrangement of FIG. 12, antenna 26 has a patch antenna resonating element 78. Antenna 26 of FIG. 12 may be fed using positive antenna feed terminal 60 and ground antenna feed terminal 62. Antenna 26 in FIG. 12 may be formed in stand 42 of FIG. 3. Ground 60 may be associated with housing 12 or other suitable ground plane elements in device 10.

Figure 13:
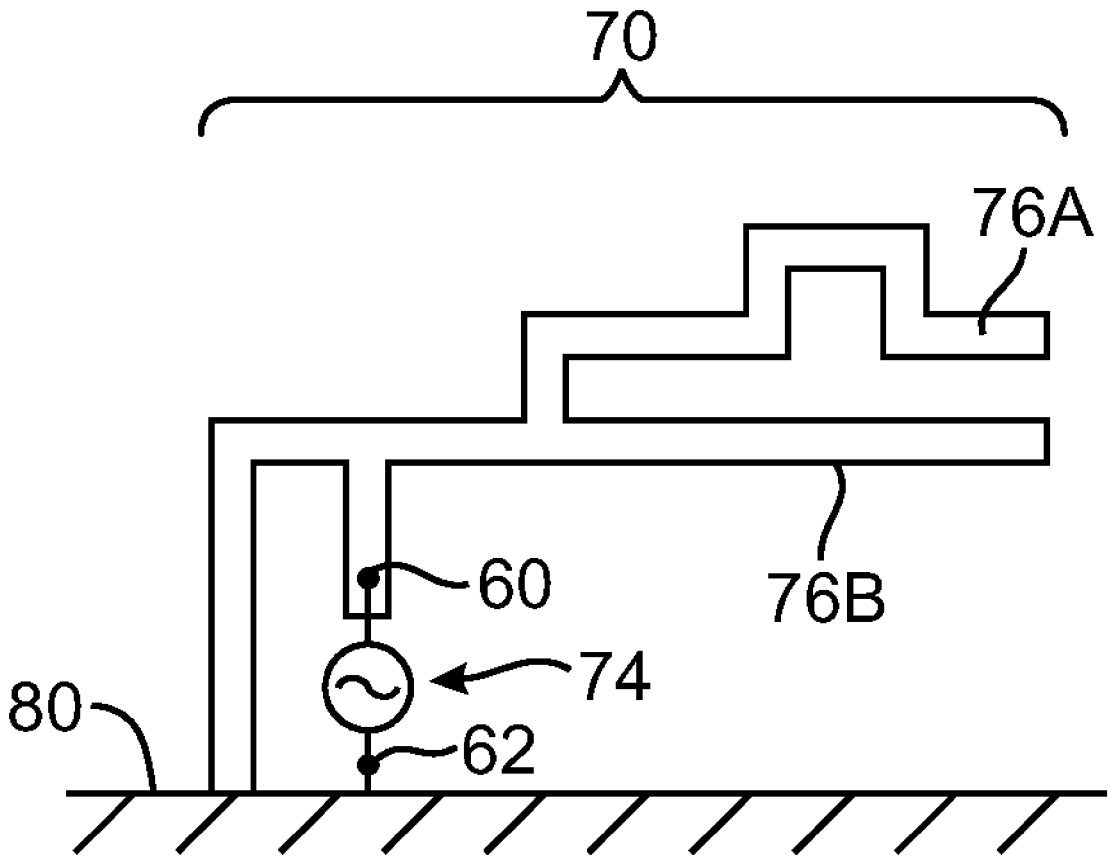
FIG. 13 is a diagram of an illustrative multibranch inverted-F antenna resonating element for an antenna in accordance with an embodiment of the present invention.

FIG. 13 shows another illustrative configuration that may be used for the antenna structures of antenna 26. In the FIG. 8 example, antenna resonating element 70 has two main arms. Arm 76A is shorter than arm 76B and is therefore associated with higher frequencies of operation than arm 76A. By using two or more separate resonating element structures of different sizes, antenna resonating element 70 of FIG. 13 can be configured to cover a wider bandwidth or more than a single communications band of interest. Antenna 26 in FIG. 13 may be formed in stand 42 of FIG. 3. Ground 80 may be associated with housing 12 or other suitable ground plane elements in device 10.

Figure 14:
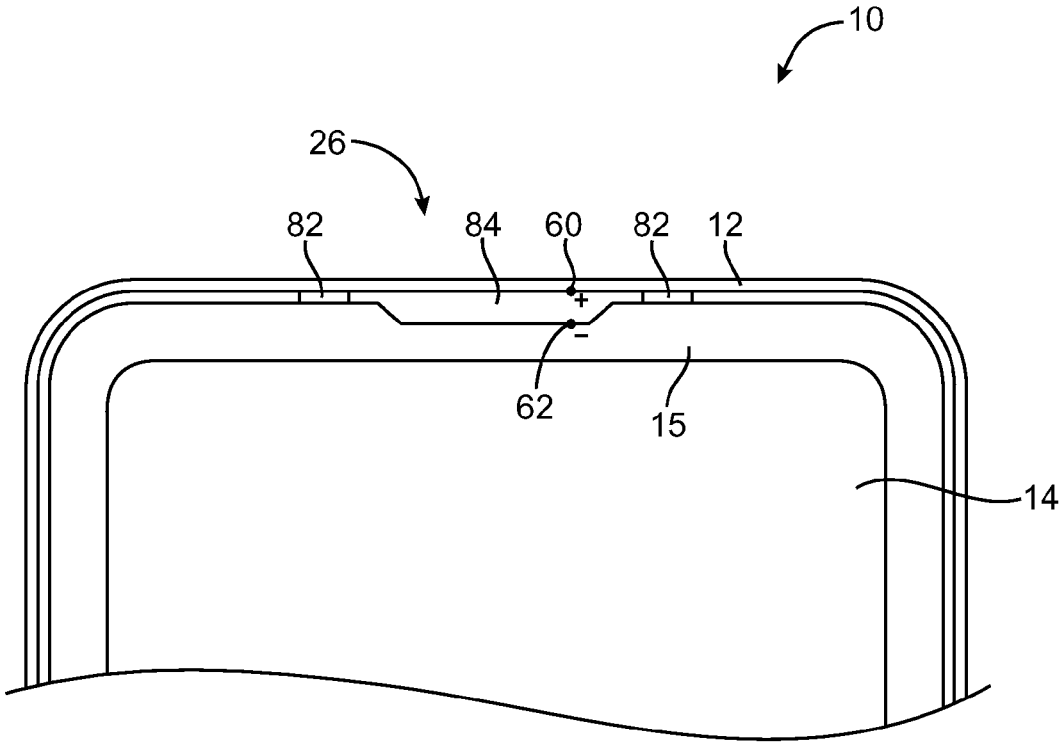
FIG. 14 is a diagram of an electronic device slot antenna formed from a gap between a housing and a frame in accordance with an embodiment of the present invention.

As shown in FIG. 14, antenna 26 may be formed from a gap or space between conductive housing 12 and conductive internal frame 15 of electronic device 10. Device 10 may be any suitable electronic device (e.g., device 10 in FIGS. 1-5) such as a portable computer or handheld electronic device. Housing 12 may be mounted on internal frame 15. There may be a gap 84 between housing 14 and internal frame 15. Gap 84 may be filled with air, plastic, epoxy, or other suitable dielectric materials. Housing 12 may be formed from metal or another conductive material. Internal frame 15 may be, for example, a frame that is used to form a structural support for display 14 (FIG. 1) Frame 15 may be formed from aluminum or other suitable conductive materials. Frame 15 may be mounted to the inside surface of housing 12 using welds, adhesive, fasteners, or other suitable attachment mechanisms. Conductive materials 82 may help electrically connect housing 12 to internal frame 15 so that gap 84 forms a closed slot. Antenna 26 may be fed by positive feed terminal 60 and negative feed terminal 62 that are positioned on either side of gap 84 (as an example). One of the feed terminals may be located on housing 12 and the other feed terminal may be positioned on internal frame 15. Antenna 26 of FIG. 14 may be fed by a transmission line such as a coaxial transmission line or using any other suitable feeding arrangement.

Figure 15:
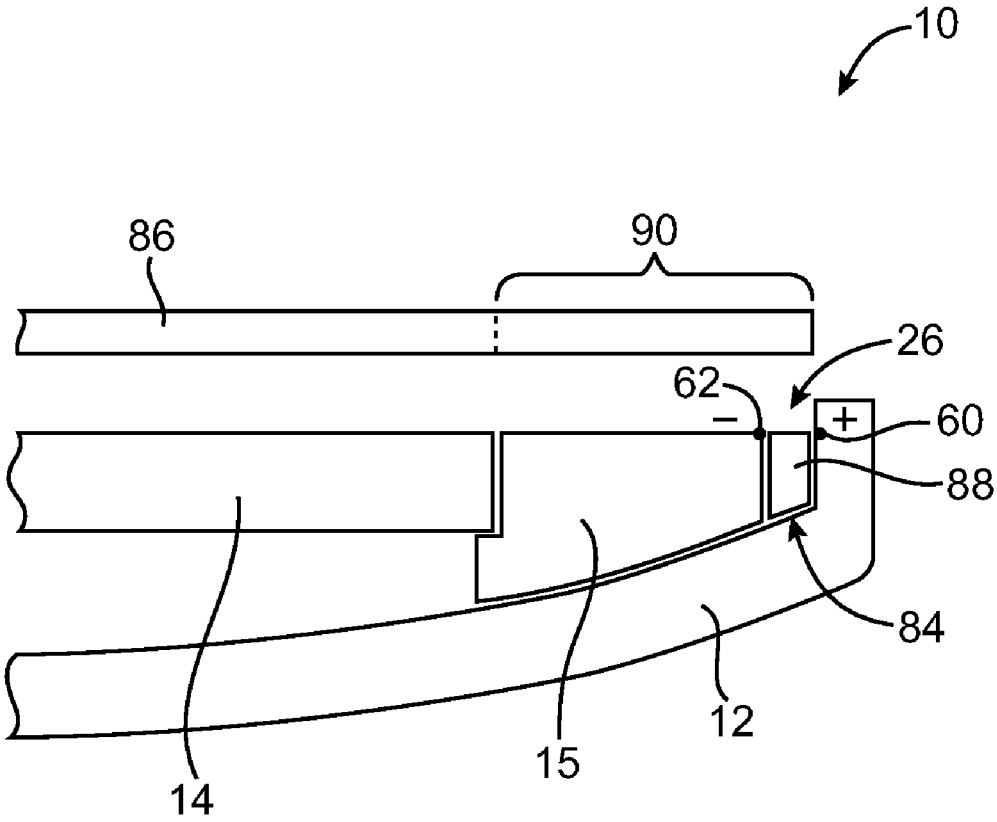
FIG. 15 is a cross section of an electronic device antenna formed between a housing and a frame in accordance with an embodiment of the present invention.

FIG. 15 shows a cross section of an electronic device 10 that has an antenna 26 formed in a gap 84 between housing 12 and frame 15. Antenna 26 may have a positive feed terminal 60 and a negative feed terminal 62 located on either side of gap 84, so that one feed terminal is located on housing 12 and the other feed terminal is located on internal frame 15. The gap between housing 12 and frame 15 may be filled by air or with a solid dielectric 88. Dielectric 88 may be plastic, epoxy, or any other suitable dielectric material. Frame 15 may form a support for display 14. Cover glass 86 may be positioned over display 14 and frame 15, and may optionally be positioned over antenna 26. The portion of cover glass 86 in region 90 may have an undercoat of an opaque ink such as a black ink, preventing antenna 26 from being viewed by a user of device 10. The opaque ink in region 90 may be provided in a layer that is sufficiently thin to ensure that the ink layer is transparent to radio-frequency signals. Because glass 86 is a dielectric and because the opaque ink is sufficiently thin, radio-frequency signals for antenna 26 are not blocked by glass 86 or the ink in region 90.

Figure 16:
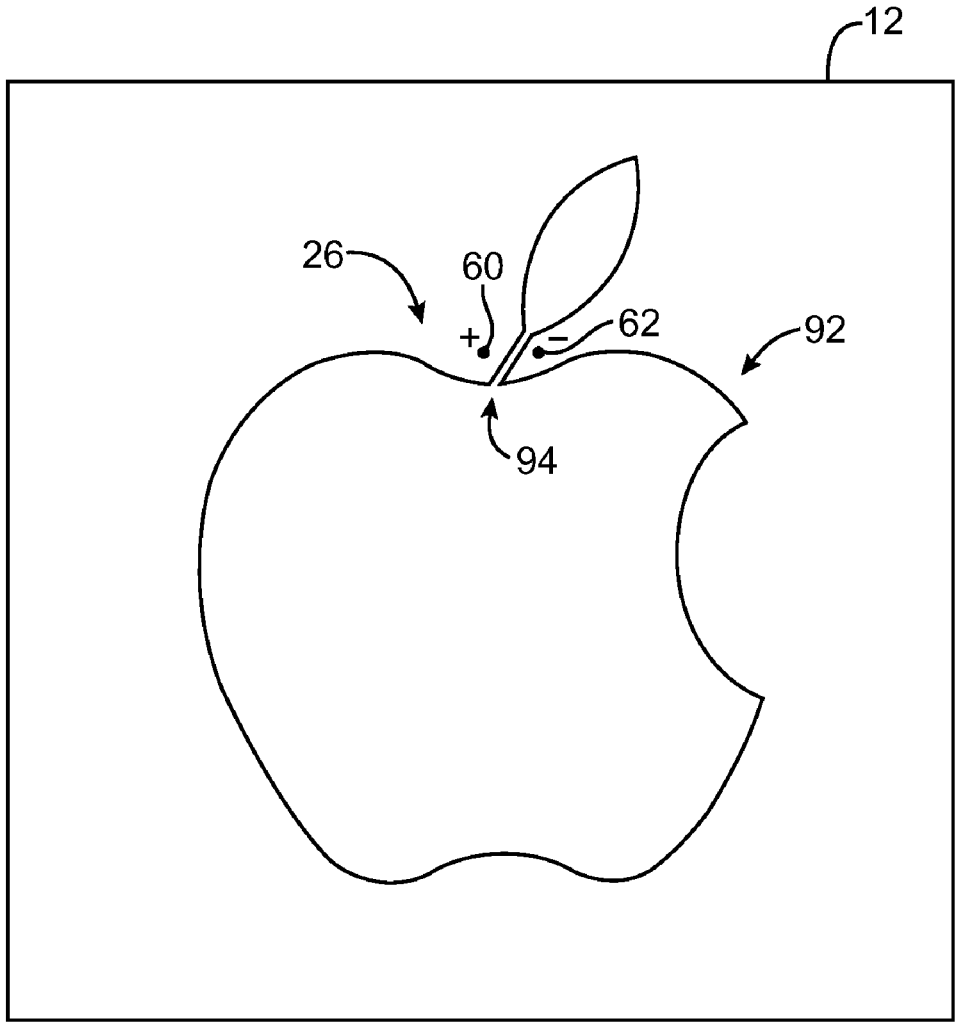
FIG. 16 is a diagram of an electronic device antenna formed across a logo in a conductive housing that has a narrow portion that forms a slot in accordance with an embodiment of the present invention.

As shown in FIG. 16, slot antenna 26 may be formed as part of a logo. Because a logo carries branding information or other information that is of interest to the user of the electronic device, a logo may serve a useful and accepted information-conveying purpose and need not introduce an undesirable visible design element to the exterior of the electronic device. Housing 12 may be formed of conductive material such as metal. Logo structure 92 may be formed of a dielectric material such as plastic embedded in a corresponding logo-shaped opening in housing 12. Logo structure 92 may have a slot-shaped narrow region 94. Antenna 26 may have positive feed terminal 60 and a negative feed terminal 62 on either side of narrow region 94 on logo 92. All or part of logo structure 92 (e.g., narrow region 94) may function as a slot and may serve as an antenna resonating element for antenna 26. Logo structure 92 may be any logo that has dimensions suitable for an antenna 26. Logo structure 92 need not have the form depicted in FIG. 16. Logo 92 may be formed anywhere on housing 12. For example, logo 92 may be formed in regions 19B-19D of housing 12 in FIG. 2, in region 19E of FIG. 3, or in region 48 of FIG. 5.

Figure 17:
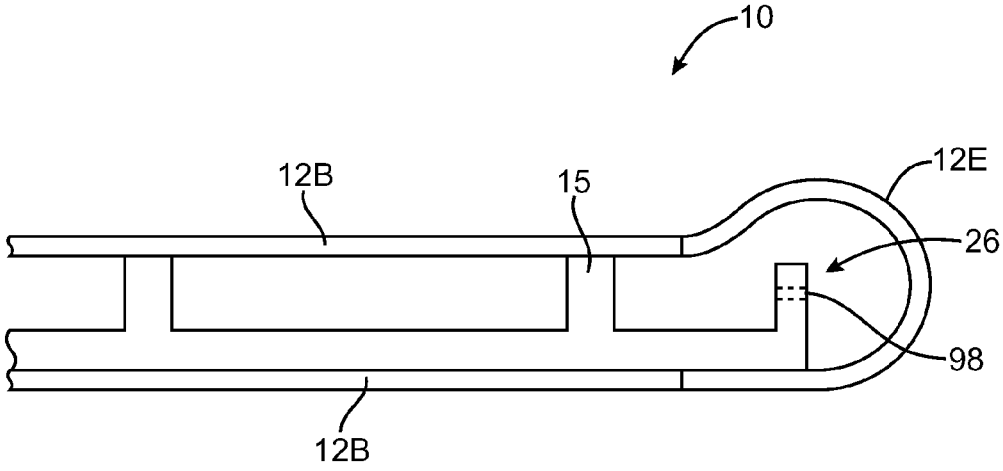
FIG. 17 is a cross sectional view of an antenna formed from slots in an internal frame in accordance with an embodiment of the present invention.

Antennas may also be formed from slots an in internal housing. FIG. 17 shows a cross section along dashed line 96 of device 10 of FIG. 1. FIG. 17 shows lower housing portion 12B and housing portion 12E which surrounds a portion of device 10 that lies between hinges 13 (see, e.g., FIG. 1). Internal frame 15 may provide support for housing 12B and for internal components such as circuit boards. Internal frame 15 may be made of conductive materials such as aluminum. One or more slots 98 may be formed in a section of internal frame 15 that lies inside housing portion 12E. Slots 98 may serve as antenna resonating elements for antenna 26 and may have longitudinal axes that run parallel to the clutch barrel hinges of device 10 (i.e., that run parallel to the back edge of device 10). Housing portion 12E may be formed from dielectric materials so that radio-frequency signals can pass through housing portion 12E. A dielectric housing portion 12E may serve as a dielectric window for antenna 26.

There may be one slot 98 so that antenna 26 is a single slot antenna such as in FIG. 7. There may also be two slots 98 so that antenna 26 is a dual slot antenna as in FIG. 8. Slots 98 may be open or closed slots such as in the example of FIG. 9. One or more slot antennas 26 may be formed in internal frame 15. Any suitable feeding arrangement may be for antenna 26 of FIG. 17. For example, a coaxial transmission line may be used to feed antenna 26 of FIG. 17.

Figure 18:
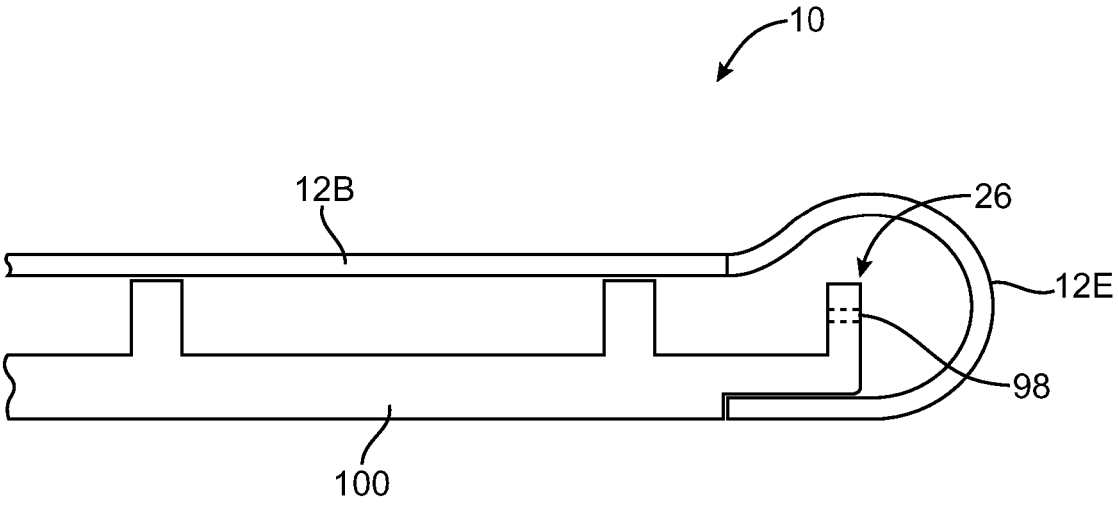
FIG. 18 is a cross sectional view of an antenna formed from slots in a frame that is integral with a housing in accordance with an embodiment of the present invention.

FIG. 18 shows how a housing portion of device 10 may have an integrated frame. Frame 100 in FIG. 18 is a frame that also serves as a housing portion. Frame 100 may be machined or cast out of a single piece of material such as aluminum. Slots 98 may be formed in frame 100. Housing portion 12E surrounding slots 98 may be made of nonconductive or dielectric materials to allow radio-frequency signals to pass through housing 12E. A dielectric housing portion 12E may serve as a dielectric window for antenna 26. Frame 100 may be used conjunction with other housing portions such as housing 12B. Slots 98 serve as antenna resonating elements for antenna 26 in FIG. 18. Slots 98 may be single or double slots and may be open or closed slots. One or more slot antennas 26 may be formed in frame 100. A coaxial transmission line or any suitable feeding arrangement may be used to feed antenna 26.

Figure 19:
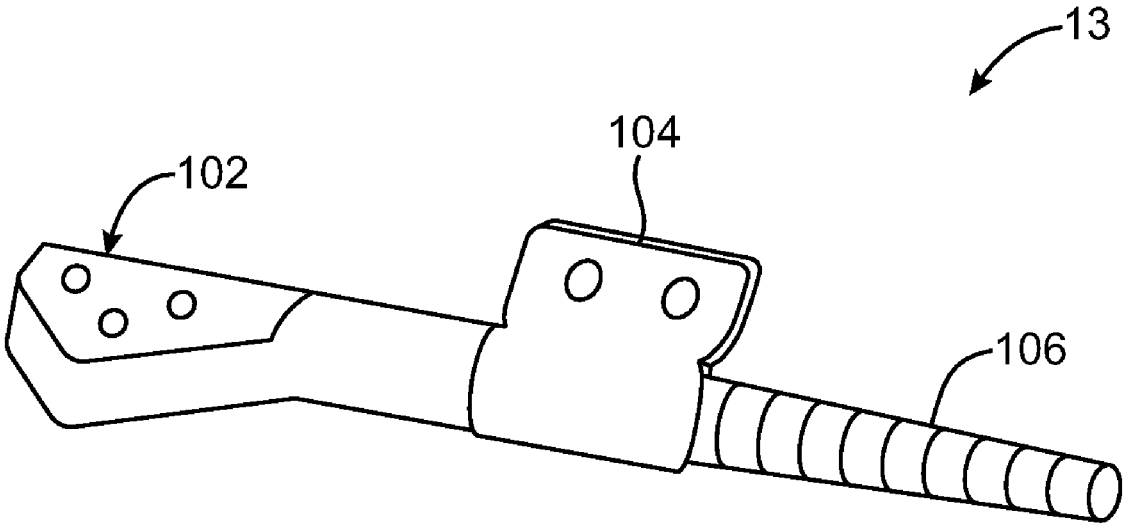
FIG. 19 is a diagram showing an illustrative hinge in accordance with an embodiment of the present invention.

FIG. 19 shows an illustrative hinge. Member 102 of hinge 13 may connect to a lower portion of device 10. For example, member 102 may connect to frame 15 of FIG. 17 or frame 100 of FIG. 18. Hinge 13 may have a member 104 that connects to an upper portion (or cover) of device 10 such as portion 12A. Parts 102 and 104 may rotate with respect to each other as the upper portion or cover of device 10 opens and closes. Hinge 13 may have a spring 106 that helps to control the motion of hinge 13. When installed in device 10, slot antennas formed on the frame of device 10 may be located between a pair of hinges 13 under region 19A of FIG. 1.

Figure 20:
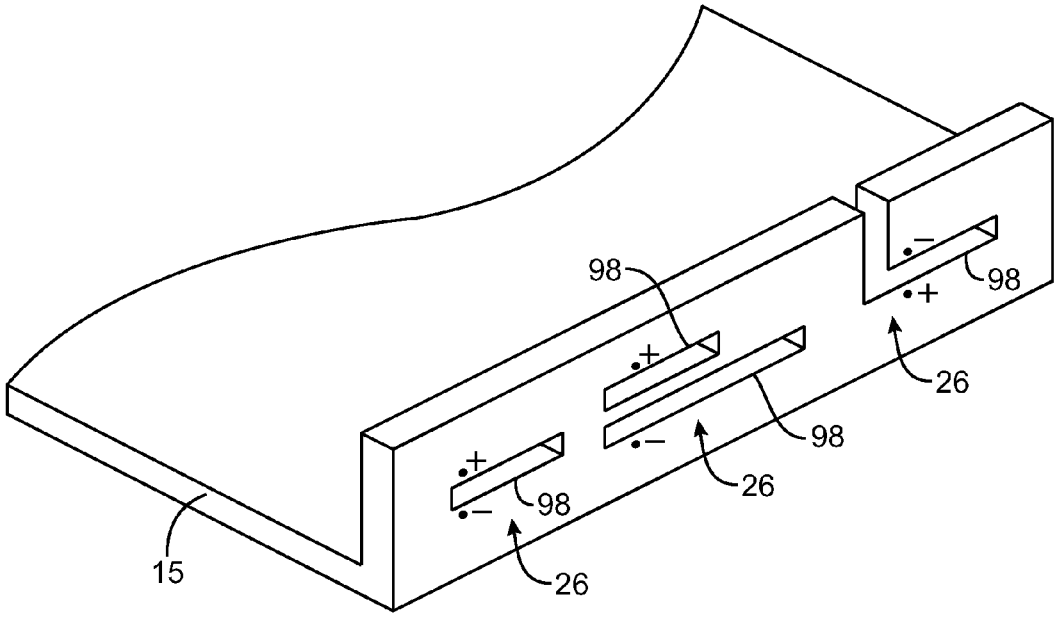
FIG. 20 is a perspective view of slot antennas formed in a conductive frame in accordance with an embodiment of the present invention.

FIG. 20 shows a perspective view of configuration that may be used for the slot antennas of FIGS. 17 and 18. As shown in FIG. 20, slot antennas 26 may have antenna resonating elements formed from slots 98 in frame 15. Antenna 26 may have a single slot, double slots, an open-ended L-shaped slot, or any suitable slot configuration. Antennas 26 may have positive and negative feed terminals. There may be more than one antenna 26 formed in frame 15. The slot configurations of FIG. 20 may also be formed in frame 100 of FIG. 18 that also serves as a housing.

The foregoing is merely illustrative of the principles of this invention and various modifications can be made by those skilled in the art without departing from the scope and spirit of the invention.

What is claimed is:

1. An electronic device comprising:

a conductive housing;

a conductive internal frame connected to the conductive housing, wherein the conductive internal frame is mounted within the conductive housing; and an antenna having an antenna resonating element formed from a gap between the conductive internal frame and the conductive housing.

2. The electronic device defined in claim 1 wherein the antenna further comprises first and second feed terminals, wherein the first feed terminal is located on the conductive housing and wherein the second feed terminal is located on the conductive internal frame.

3. The electronic device defined in claim 1 further comprising a display that is connected to the internal frame.

4. The electronic device defined in claim 3 wherein a solid dielectric material fills the gap between the conductive internal frame and the conductive housing.

5. The electronic device defined in claim 1 wherein the gap comprises a closed slot.

6. An electronic device comprising:

a conductive housing member that forms at least one exterior surface of the electronic device;

at least one conductive internal member electrically connected to the conductive housing member, wherein the conductive internal frame member lies inside the conductive housing member; and an antenna having an antenna resonating element formed from a gap between the conductive internal member and the conductive housing member, wherein the antenna comprises a first feed terminal electrically coupled to the exterior surface formed by the conductive housing member and a second feed terminal located on the conductive internal member.

7. The electronic device defined in claim 6 further comprises a solid dielectric material in at least part of the gap between the conductive internal member and the conductive housing member.

8. The electronic device defined in claim 6 further comprising a display with an associated optically transparent layer, wherein the optically transparent layer has a portion that overlaps the gap between the conductive internal member and the conductive housing member.

9. The electronic device defined in claim 8 further comprising an opaque material on the portion of the optically transparent layer that overlaps the gap between the conductive internal member and the conductive housing member.

10. The electronic device defined in claim 8 further comprising an opaque material on the portion of the optically transparent layer that overlaps the gap between the conductive internal member and the conductive housing member, wherein the opaque material is transparent to radio-frequency signals.

11. The electronic device defined in claim 10 wherein the optically transparent layer comprises glass.

12. The electronic device defined in claim 11 wherein the conductive internal member comprises a conductive internal frame member that structurally supports the display.

13. An electronic device comprising:

a conductive housing member that substantially surrounds the electronic device, wherein the conductive housing members forms exterior surface portions of a perimeter of the electric device;

at least one conductive internal member electrically connected to the conductive housing member, wherein the conductive internal member is within the conductive housing member; and an antenna having an antenna resonating element formed from a gap between the conductive internal member and the conductive housing member, wherein the antenna comprises a first feed terminal electrically coupled to one of the exterior surface portions formed by the conductive housing member and a second feed terminal located on the conductive internal member.

14. The electronic device defined in claim 13 further comprises a solid dielectric material in at least part of the gap between the conductive internal member and the conductive housing member.

15. The electronic device defined in claim 13 further comprising a display with an associated optically transparent layer, wherein the optically transparent layer has a portion that overlaps the gap between the conductive internal member and the conductive housing member.

16. The electronic device defined in claim 15 further comprising an opaque material on the portion of the optically transparent layer that overlaps the gap between the conductive internal member and the conductive housing member.

17. The electronic device defined in claim 15 further comprising an opaque material on the portion of the optically transparent layer that overlaps the gap between the conductive internal member and the conductive housing member, wherein the opaque material is transparent to radio-frequency signals.

18. The electronic device defined in claim 17 wherein the optically transparent layer comprises glass.

19. The electronic device defined in claim 18 wherein the conductive internal member comprises a conductive internal frame member that structurally supports the display.

20. The electronic device defined in claim 13 wherein the first feed terminal comprises a positive feed terminal located on the conductive housing member.

* * * * *

UNITED STATES PATENT AND TRADEMARK OFFICE

CERTIFICATE OF CORRECTION

PATENT NO. : 8,269,675 B2
APPLICATION NO. : 12/490286
DATED : September 18, 2012
INVENTOR(S) : Douglas B. Kough et al.

It is certified that error appears in the above-identified patent and that said Letters Patent is hereby corrected as shown below:

In the Claims:

In claim 7, column 12, lines 33-34 delete "further comprises" and insert
-- further comprising --

In claim 13, column 12, lines 59-60 delete "wherein the conductive housing members forms" and insert -- wherein the conductive housing member forms --

In claim 14, column 13, lines 6-7 delete "further comprises" and insert
-- further comprising --

Signed and Sealed this
Eighteenth Day of June, 2013

Teresa Stanek Rea
*Acting Director of the United States Patent and Trademark Office*